United States Patent [19]

Jeffrey

[11] 4,004,697

[45] Jan. 25, 1977

[54] VISUAL COUPLING INDICATOR FOR AUTOMATIC RAILWAY CAR COUPLERS

[75] Inventor: William B. Jeffrey, North Huntingdon, Pa.

[73] Assignee: Westinghouse Air Brake Company, Wilmerding, Pa.

[22] Filed: Feb. 9, 1976

[21] Appl. No.: 656,316

[52] U.S. Cl. ..... 213/75 R; 213/1 R; 213/100 R

[51] Int. Cl.[2] ..... B61G 3/10

[58] Field of Search ..... 213/1 R, 75 R, 100 R, 213/100 W, 104, 109, 125, 159–161, 166, 211; 116/114 R, 123

[56] References Cited

UNITED STATES PATENTS

| | | | |
|---|---|---|---|
| 3,780,879 | 12/1973 | Wright | 213/75 R |
| 3,865,252 | 2/1975 | Bridigum et al. | 213/75 R |

*Primary Examiner*—Drayton E. Hoffman
*Assistant Examiner*—Fred A. Silverberg
*Attorney, Agent, or Firm*—R. S. Visk; R. W. McIntire, Jr.

[57] ABSTRACT

A visual indicator engageable and operable by a movable locking member of an automatic type railway car coupler for indicating a locked or unlocked condition of the locking member and, therefore, the coupled or uncoupled condition of the coupler, said indicator being readily visible from both sides of the coupler or train.

8 Claims, 4 Drawing Figures

Fig. 1
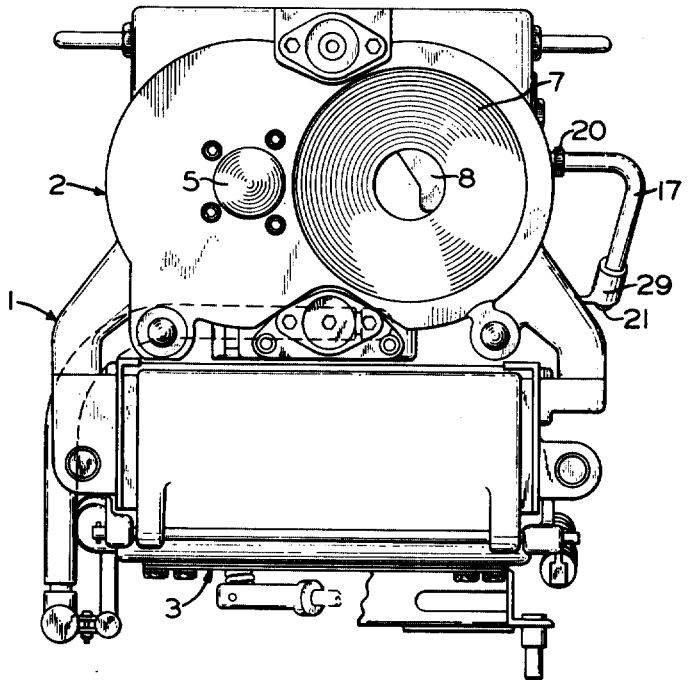
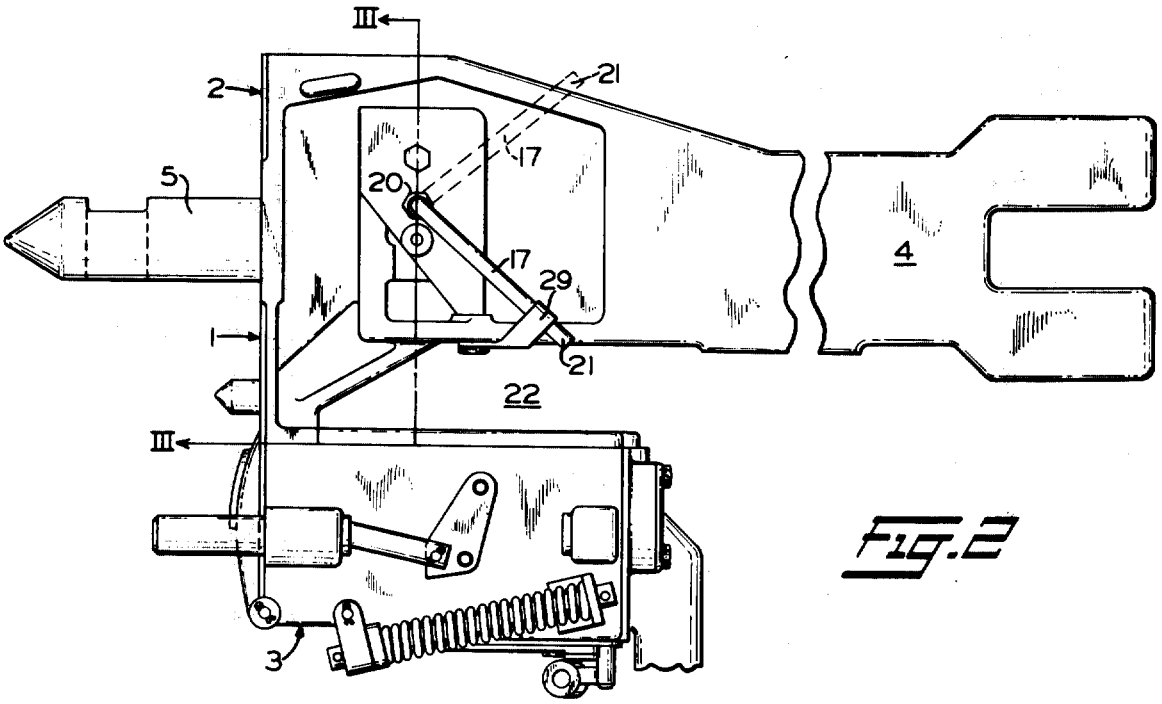
Fig. 2

VISUAL COUPLING INDICATOR FOR AUTOMATIC RAILWAY CAR COUPLERS

BACKGROUND OF THE INVENTION

Although some of the presently known automatic car couplers of the type used for rapid transit equipment for automatically effecting concurrent coupling of the cars, the air conduits, and the electrical circuits when the cars are brought together, are provided with visual indicators visible from both sides of the train without the necessity of passing from one side of the train to the other for ascertaining that locking of both heads has positively been effected, such known indicator means may possibly possess certain objectionable characteristics. The above-mentioned type of indicator may comprise an axially flexible, closely wound spring attached at one end to an axially movable locking member of the coupler and slidably disposed in a fixed guide tube such that when the locking member is in a locked condition, the spring member is fully retracted within the guide tube, but if the locking member is in an unlocked condition, a certain amount of the free end of the spring member protrudes or projects beyond the open end of the guide tube, thus indicating an unlocked condition. If the guide tube, during service, inadvertently became pinched or crimped, the spring could possibly become jammed in the tube and thereby cause the locking member to hang up. Moreover, the loose end of the coil spring could also possibly catch on the open end of the guide tube to prevent free movement thereof and of the locking member.

SUMMARY OF THE INVENTION

The object of the present invention, therefore, is to provide an improved latch indicator device similar to the type above described, but arranged such that in the event the indicator spring does get jammed in the guide tube, the locking member remains unhindered in its operation to its locking or unlocking positions to assure proper coupling or uncoupling operation.

Briefly the invention comprises a closely wound, flexible coil spring (a screen door type, for example) axially slidably disposed in a guide tube secured to the coupler casing in such position that one end (the inner end) of said spring is axially aligned with and makes separable contact with an axially movable locking member of a car coupler, while the other end (the free outer end) of said spring is free to be projected beyond the open end of the guide tube into a visible position by operation of the locking member to an unlocked position, which is so indicated by said visible position of the spring. A small biasing spring is arranged adjacent the free end of the indicator spring for retracting said indicator spring entirely within the guide tube out of view when the locking member operates to a locking position, which is thus indicated by the retracted indicator spring. Because of the manner in which the indicator spring is arranged, a certain length of said spring is free to flex to thereby permit the locking member to move to its unlocked position notwithstanding that the indicator spring is immovably jammed in the guide tube. Moreover, since the inner end of the indicator spring makes separable contact with the locking member, said locking member is free to separate and move away from said spring and thereby move to its locking position notwithstanding that the spring is immovably hung up in the guide tube.

In the drawings:

FIG. 1 is a vertical frontal view, in outline, of an automatic type car coupler showing the invention mounted thereon;

FIG. 2 is a vertical side view, in outline and as viewed from the right side of FIG. 1, of the car coupler shown in FIG. 1;

DESCRIPTION AND OPERATION

Figure 3:
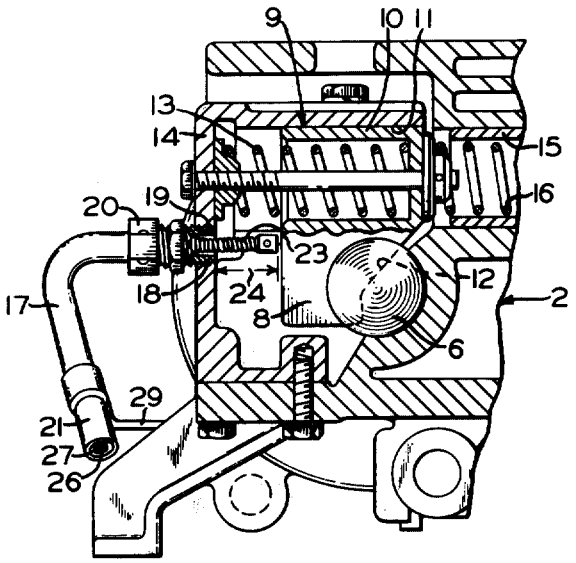
FIG. 3 is a sectional view taken along line III—III of FIG. 2 on a somewhat larger scale than FIGS. 1 and 2, and as viewed in the direction indicated by the arrows.

Referring to FIGS. 1 and 2 of the drawings, reference numeral 1 generally designates a mating head which, with a counterpart mating head (not shown), comprises an automatic railway car coupler, said mating head comprising a coupling portion or head 2 and an electrical connecting portion 3 supported thereon, the entire mating head being supported on the car by a mounting bar 4 forming part of and extending axially from the coupling portion so as to be connected to the end of a draft gear (not shown) of the vehicle.

Each of the mating heads is also provided with a coupling pin, designated by reference numeral 5 on mating head 1 in FIGS. 1 and 2, projecting horizontally from the face thereof parallel to the longitudinal axis of the car and offset to one side of the vertical center line of the mating head. As the two mating heads move toward a coupled relation, the respective coupling pins are guided into engagement with the opposite respective mating heads by funnel shaped depressions or gathering cones formed on the faces of the coupling portions of said mating heads, respectively. Thus, a coupling pin 6 of the mating head counterpart to mating head 1 (only said pin 6 of the counterpart mating head being shown) would be guided into such engagement by entering an aligned funnel shaped depression or gathering cone 7 formed in the face of coupling portion 2 of mating head 1, and would appear in such engaged position as shown in the sectionalized view of mating head 1 in FIG. 3. The leading end or nose of coupling pin 6 (as well as that of coupling pin 5) tapers to a rounded end so that, upon entering gathering cone 7 of mating head 1, the rounded nose makes contact with an inner edge of a spur portion 8 formed on a locking member 9 operably disposed in coupling portion 2 perpendicularly relative to coupling pin 6 which, upon movement into said gathering cone, forces axial displacement of said locking member in a left-hand direction, as viewed in FIG. 3, to an unlocking position.

The locking member 9 includes a cylindrical cup-like portion 10 which along with axial movement of said locking member, is slidably reciprocable within a coaxial bore 11 formed in the casing of coupler portion 2. When the mating heads have moved into complete abutting contact upon completion of coupling operation, coupling pin 6 of the counterpart mating head will have been received completely by gathering cone 7 of mating head 1 to occupy a coupled position in which a transverse notch 12 formed in said coupling pin is aligned oppositely to spur 8. When such alignment occurs, a spring 13 compressed between the bottom of cup-like portion 10 and the inner side of a side wall 14 of the casing urges locking member 9 in a right-hand direction, as viewed in FIG. 3, to cause spur 8 to be firmly lodged in notch 12 of coupling pin 6 for locking said pin in its coupled position. A similar action occurs concurrently when coupling pin 5 of mating head 1 is engaged by the counterpart mating head, so that the two mating heads comprising the coupler are effectively and positively locked in a coupled relationship.

The coupler portion 2 is provided with power operated piston means including a striking member 15 for effecting unlocking of locking member 9 from coupler pin 6 when uncoupling operation is initiated. When the power operated piston means is subjected to a sudden burst of fluid pressure, the striking member 15 is caused to deliver a hammer-like blow to the cuplike portion 10 for effecting leftward movement of locking member 9 to its unlocking position in which spur 8 is dislodged from notch 12 of pin 6. Subsequent to disengagement of coupling pin 6 and dissipation of fluid pressure from the piston means at a controlled restricted rate, the striking member 15 and the locking member 9 are restored to respective normal positions by a spring 16 acting on said striking member in the same direction as spring 13 acting on said locking member, said normal position and the locking position, above described, of said locking member being the same except that in the normal position the coupling pin is disengaged and in the locking position the coupling pin is engaged.

According to the invention, a guide tube 17 has one end 18 secured in an opening 19 formed in side wall 14 directly opposite spur portion 8 of locking member 9, said one end of said guide tube being secured in said opening by any suitable means such as a pipe fitting 20. Tube 17 may be made from any suitable material such as hardened copper or a plastic composition and may be of such preformed shape that, at a suitable point, it curves downwardly and rearwardly relative to coupling portion 2, as may best be seen in FIG. 2. Tube 17 opposite end 18 secured in side wall 14, terminates with a free end 21 disposed relative to coupling portion 2 and electrical portion 3 such that it projects into an empty space generally designated by reference number 22, the upper and lower limits of said empty space being defined, respectively, by said coupling portion and said electrical portion. Thus, an unobstructed view, from both sides of the train is had for any objects extending out of end 21 of tube 17 into space 22.

It should be apparent that guide tube 17 does not necessarily have to be curved in the direction above described. Tube 17, for example, could be bent in an upwardly direction, as shown in broken outline in FIG. 2, so as to have the end 21 extending beyond the upper limit of coupler portion 2. In such position, end 21 of tube 17 is also visible unobstructedly from both sides of the train, but is more vulnerable to entry of water or other foreign matter thereinto, which is not desirable.

Figure 4:
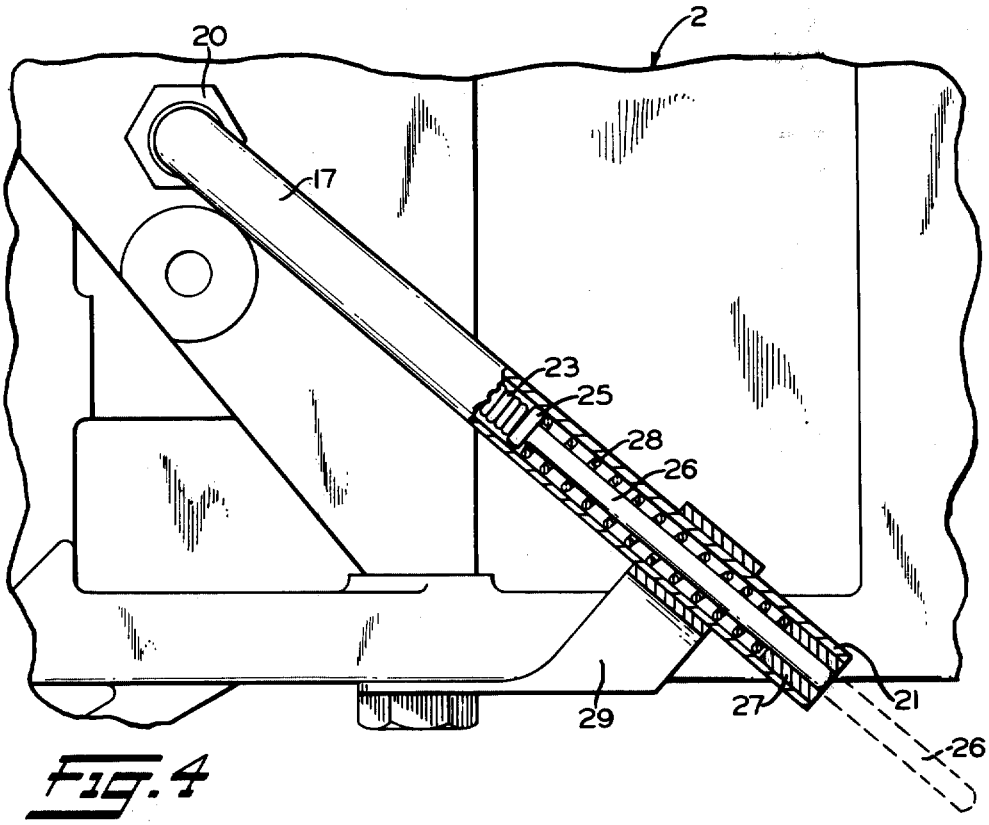
FIG. 4 is a fragmentary view, partly in section and partly in outline and on a larger scale than FIG. 3, of that area of FIG. 2 in which the invention is shown.

Also, according to the invention and as best seen in FIGS. 3 and 4, a closely wound, flexible coil indicator spring 23 similar to a screen door type spring, for example, is coaxially disposed within guide tube 17, the inner diameter of which is large enough to accommodate free axial movement of said spring. One end, that is, the inner end of spring 23 is intended to normally remain in resting contact against but freely separable from spur portion 8 of locking member 9 in axial alignment with the axial direction of movement of said locking member. A certain axial portion, as indicated at 24 of FIG. 3, of spring 23 between locking member 9 and end wall 14, where the spring enters tube 17, is unsheathed and therefore free to flex for a purpose to be hereinafter disclosed.

As previously noted, spring 23 extends coaxially through guide tube 17 and, as shown in FIG. 4, has the end opposite unsheathed portion 24 affixed to a collar 25 formed on an adjacent end of a rod-like indicator member 26 extending axially away from said collar. The diameter of collar 25 is such as to permit free axial movement thereof, and therefore of spring 23, within guide tube 17. Rod-like indicator member 26 extends away from collar 25 and slidably through a bushing 27 fixed coaxially in and flush with the extremity of end 21 of tube 17, said bushing acting as a guide for said indicator member as well as means for excluding foreign matter from entering the tube. The overall length of spring 23, collar 25, and indicator member 26 is such that when locking member 9 and spur portion 8 are in their respective normal or locking positions, above defined, said indicator member is fully retracted within tube 17 by a return spring 28 compressed between collar 25 and bushing 27 in surrounding relation to said indicator member. Thus, the fully retracted indicator member indicates a locked condition of the coupler.

If, during coupling operation, locking member 9 and therefore spur portion 8 of either of the mating heads fail to assume their locked position, above described, spring 23 is compressed by said spur portion remaining in its unlocked position to force indicator member 26 out of tube 17 into view of the crewman checking the coupler from either side of the train.

As was hereinbefore mentioned, the end of spring 23 adjacent spur portion 8 is not fixed to said spur portion, but is arranged for making abutting contact only therewith. Should spring 23 become stuck or jammed in guide tube 17, as by reasons of freezing therein or of accidental pinching or crimping of the tube, locking member 9, during coupling operation, would still be free to move away from the end of said spring and, therefore, to its locked position. Or, on the other hand, during uncoupling operation and, therefore, movement of locking member 9 to its unlocking position, the unsheathed portion 24 of spring 23 is flexible enough to be buckled into the surrounding space by leftward movement, as viewed in FIG. 3, of spur portion 8 of said locking member, so as to not hinder unlocking of the coupler.

As best seen in FIGS. 2 and 4, a suitably located bracket 29 has one end securely bolted to the casing of coupler portion 2 and the other end surrounding and firmly clasping tube 17 in the general vicinity of end 21 of said tube for retaining the tube in its proper position.

Having now described the invention what I claim as new and desire to secure by Letters Patent, is:

1. A visual coupling indicator for use with a railway car coupler comprising a casing for a mating head disposed axially parallel to the longitudinal axis of the car for mating with a counterpart mating head, said casing being of predetermined vertical dimension defined by upper and lower limits and having operably disposed therein a movable locking member biased to a locking position in which a coupling pin of the counterpart mating head is engaged for locking the mating heads in a coupled relation, and being operable to an unlocking position in which the coupling pin of the counterpart mating head is disengaged for releasing the coupled relation, said visual coupling indicator comprising:

a. a tubular member disposed externally of the casing with one end fixed to the side thereof adjacent to and in alignment with the line of movement of the locking member, said tubular member being curved such that the other end thereof extends beyond one of the upper and lower limits of the casing;

b. a flexible spring member having one end making separable abutting contact with the locking member and extending therefrom through said tubular member, said flexible member being of such length as to occupy a fully retracted position within the tubular member when the locking member is in its said locking position and to have the other end thereof extending exteriorly and beyond the other end of said tubular member into a visible position when the locking member is in its said unlocking position; and c. indicator biasing means effective, upon movement of the locking member to the locking position, for biasingly returning said flexible member to its said fully retracted position, and being yieldable to movement of the locking member to the unlocking position for effecting operation of the flexible member to its said visible position.

2. A visual coupling indicator, as set forth in claim 1, wherein movement of the locking member is normal to both the longitudinal axis of the car and the vertical axis of the casing.

3. A visual coupling indicator, as set forth in claim 1, wherein said tubular member curves away and downwardly from its said one end so as to have the other end thereof disposed beyond the lower limit of the casing.

4. A visual coupling indicator, as set forth in claim 1, further characterized by means for securing said tubular member in a fixed selected position relative to the casing.

5. A visual coupling indicator, as set forth in claim 1, further characterized by:

a. a bushing coaxially fixed in and flush with said other end of said tubular member; and b. a rod-like member affixed to and extending axially away from said other end of said flexible spring member and slidably through said bushing for occupying either said retracted position or said visible position, depending upon the disposition of the locking member.

6. A visual coupling indicator, as set forth in claim 5, wherein said indicator biasing means comprises a return spring coaxially surrounding said rod-like member and compressibly interposed between said bushing and a collar formed on said rod-like member and to which said other end of said flexible spring member is secured, the diameter of said collar being smaller than the inner diameter of the tubular member.

7. A visual coupling indicator, as set forth in claim 1, wherein said flexible spring member comprises a flexible coil spring portion of predetermined length with said one end thereof normally resting in abutting contact against the locking member but free to separate therefrom, upon movement of the locking member away therefrom toward its said locking position, in the event that said flexible spring member hangs up in the tubular member.

8. A visual coupling indicator, as set forth in claim 7, wherein a portion of said flexible spring member between the locking member and said one end of said tubular member is unsheathed for permitting buckling thereof, upon movement of the locking member toward its said unlocking position, in the event of hang-up of the flexible spring member in the tubular member.

* * * * *